US005462072A

United States Patent [19]

Browne et al.

[11] Patent Number: 5,462,072

[45] Date of Patent: Oct. 31, 1995

[54] REMOVAL OF NICOTINE FROM TOBACCO SMOKE

[75] Inventors: Colin L. Browne, Clover, S.C.; Raymond M. Robertson, Pineville, N.C.

[73] Assignee: Hoechst Celanese Corporation, Somerville, N.J.

[21] Appl. No.: 183,107

[22] Filed: Jan. 18, 1994

Related U.S. Application Data

[63] Continuation of Ser. No. 731,965, Jul. 18, 1991, abandoned.

[51] Int. Cl.[6] ..... A24D 3/12

[52] U.S. Cl. ..... 131/334; 131/331

[58] Field of Search ..... 131/331–334

[56] References Cited

U.S. PATENT DOCUMENTS

| | | | |
|---|---|---|---|
| 2,429,567 | 12/1941 | Sowa | 131/334 X |
| 3,550,600 | 12/1970 | Horsewell et al. | 131/334 |
| 3,724,469 | 4/1973 | Reynolds et al. | 131/266 |
| 3,842,070 | 10/1974 | Harendza-Harinxma | 260/212 |
| 3,875,949 | 4/1975 | Harendza-Harixma et al. | 131/342 |
| 4,091,822 | 5/1978 | Ihrig et al. | 131/334 X |
| 4,248,251 | 2/1981 | Bryant, Jr. et al. | 131/334 |
| 4,397,321 | 9/1983 | Stuetz et al. | 131/334 |
| 4,407,863 | 10/1983 | Yui et al. | 427/213 |
| 4,414,988 | 11/1983 | Yagi | 131/334 |
| 4,612,333 | 9/1986 | Vassileff | 131/334 X |
| 4,896,683 | 1/1990 | Cohen et al. | 131/342 |
| 5,083,579 | 1/1992 | Vanin et al. | 131/334 |

FOREIGN PATENT DOCUMENTS

| | | |
|---|---|---|
| 086638 | 8/1983 | European Pat. Off. . |
| 351252 | 1/1989 | European Pat. Off. . |
| 348741 | 1/1990 | European Pat. Off. . |
| 366982 | 5/1990 | European Pat. Off. . |
| 1437830 | of 0000 | France . |
| 18358 | 6/1975 | Japan . |
| 16540 | 7/1982 | Japan . |
| 1219893 | 1/1971 | United Kingdom . |
| 1362611 | 3/1972 | United Kingdom . |
| 0374861 | 12/1989 | United Kingdom . |

OTHER PUBLICATIONS

An Abstract for Japanese Patent A–63 143 068 (Toray Ind. Inc.) from Derwent Publications Ltd., London, GB.

A Defensive Publication for U.S. Pat. No. 683,817 (Hatfield Jr.).

Smith, C. R., "Metal–Nicotine Double Sulfates" J. Amer. Chem. Soc 71, 2844–6 (1949).

*Primary Examiner*—Jennifer Bahr

*Attorney, Agent, or Firm*—R. H. Hammer, III

[57] ABSTRACT

The instant invention is directd to the removal of nicotine from tobacco smoke by the use of compounds containing a metal with a valence of +2.

5 Claims, No Drawings

REMOVAL OF NICOTINE FROM TOBACCO SMOKE

This is a continuation of application Ser. No. 07/731,965 filed on Jul. 18, 1991, now abandoned.

FIELD OF THE INVENTION

This invention is directed to the removal of nicotine from tobacco smoke by the use of compounds containing a metal having a valence of +2.

BACKGROUND OF THE INVENTION

Tobacco smoke contains many different chemical compositions, one of which is nicotine. The removal of nicotine from tobacco smoke could have a beneficial affect upon tobacco smoking products.

Various components of tobacco smoke have been eliminated by use of metal ions in the form of compounds that are adsorbed or otherwise impregnated onto the surface of the materials that can be incorporated into a filter of a smoking device. For example, in U.S. Pat. No. 3,724,469, the removal of nitrogen oxides from cigarette smoke was accomplished by the use of cobalt or iron chelates absorbed or supported on the surface of a suitable particulate support (for example activated carbon particles) which were disposed within a cigarette filter. In Japanese Kokai Patent No. 59 [1984]-16540, the absorbency of tobacco filters for substances, such as ammonia, mercaptan, etc., was enhanced by impregnating the filter with a metal tannate chelate compound. One such metal tannate chelate was formed by the reaction of ferric chloride ($FeCl_3$) and tannic acid.

SUMMARY OF THE INVENTION

The instant invention is directed to the removal of nicotine from tobacco smoke by the use of compounds containing a metal with a valence of +2.

DETAILED DESCRIPTION OF THE INVENTION

Nicotine is a component of tobacco smoke. Nicotine is an alkaloid from tobacco and is a thick water-white levorotatory oil that turns brown upon exposure to air. Nicotine is also known by the chemical name of beta-pyridyl-alpha-N-methylpyrrolidine and its chemical formula is $C_{10}H_{14}N_2$ or $C_5H_4NC_4H_7NCH_3$.

It has been determined that various compounds containing a metal having a valence of +2 can remove nicotine from tobacco smoke when that compound is incorporated as a component of the smoking device's filter. These compounds are preferably salts, organic or inorganic. Exemplary metals having a valance of +2 include, but are not limited to: iron; copper; cobalt; zinc; cadmium; nickel; manganese; magnesium; and mercury. Exemplary compounds containing a metal having a valence of +2 include, but are not limited to: ferrous ammonium sulfate; ferrous acetate; ferrous chloride; ferrous bromide; ferrous iodide; ferrous nitrate; ferrous sulfate; cupric sulfate; cupric nitrate; cupric acetate; cobalt sulfate; cobalt nitrate; zinc sulfate; cadmium sulfate; nickel sulfate; manganese sulfate; magnesium sulfate; magnesium acetate; mercuric acetate; mercuric chloride; and combinations thereof. Ferrous ammonium sulfate is preferred and shall be discussed hereinafter as representative of the class of compounds and metals discussed above.

Ferrous (valence +2) ions have an affinity for nicotine.

Ferric ions (valence +3) do not have the same affinity for nicotine. When tobacco smoke containing nicotine is contacted with a compound containing a ferrous metal, it selectively removes a portion of the nicotine from the tobacco smoke.

Preferably, the compound containing a metal having valence of +2 is disposed on the surface of the material comprising the tobacco smoking device's filter. Exemplary filter materials include, but are not limited to: cellulose esters (e.g. cellulose acetate); polyolefins (e.g. polypropylene); activated carbon or other high surface area carrier media; paper and nonwoven webs; and combinations thereof. Deposition of the compounds containing a metal having a valence of +2 onto the filter material is accomplished, preferably, via the use of aqueous solutions of the compound. The filter material is soaked in or wetted with the solution, and then dried. The aqueous solutions may contain from about 3–12% by weight of the compound; about 5–10% by weight is preferred. Alternatively, these compounds may be dissolved in a plasticizer (e.g. triacetin) and then sprayed onto the filter rod during the filter rod manufacturing process.

Filter materials treated with ferrous metal containing compounds have a tendency to change color with aging. That is filter materials treated with the ferrous metal containing compounds will become tinted with a reddish brown color within days after treatment. This discoloration is most likely due to the oxidation of ferrous metal to ferric metal. This discoloration may be inhibited by increasing the acidity of treatment solution. Increasing the acidity the treatment solution may be accomplished without deleterious affect upon the nicotine affinity of the ferrous compounds by the addition of phosphoric acid ($H_3PO_4$) or monosodium phosphate (MSP), for example. The addition of about 1% by weight of phosphoric acid is preferred.

The foregoing invention shall be explained in greater detail with reference to the following examples.

EXAMPLE 1

The following example demonstrates the efficacy of compounds containing a ferrous metal for the removal of nicotine from tobacco smoke.

An aqueous 6% by weight solution of ferrous ammonium sulfate is prepared in a known manner. A fresh solution has a pale green color. Two types of filter rods are used: 1) standard cellulose acetate filter as used in the standard 85 mm cigarettes; and 2) sheath/core filter where the sheath is regenerated cellulose and the core is cellulose acetate (for example see British Patent Specification No. 1,219,893).

Filter rods are treated with fresh solution. Treatment involves the immersion of the rods in the solution at ambient temperature for a period of time sufficient for complete wetting. These wetted rods are vacuumed to remove excess solution and dried to a constant weight at ambient pressure. The remaining solution was covered and saved.

On the fourth day after the solution was prepared, it had changed color to reddish brown and a reddish brown precipitate had formed. The reddish brown liquid was decanted from the precipitate. The precipitate was washed with fresh water and it was put into an aqueous suspension in a known manner.

Filter rods were then treated in the same manner described above with the 4 day reddish brown liquid and the aqueous suspension of the precipitate.

The treated filter rods were formed into cigarette and then subjected to smoke trials on a Filtrona Model SM 350 (20 channel Smoking Machine) testing machine. The results are set forth in TABLE I.

TABLE I

| | STANDARD ACETATE FILTER ON STD. 85 MM FILTER | | | | HETEROFIL FILTER ON STD. 85 MM FILTER | | | |
|---|---|---|---|---|---|---|---|---|
| | Treatment | | | | | | | |
| | Water | Liquid | Precipitate | 6% FAS[3] | Water | Liquid | Precipitate | 6% FAS. |
| Cigarette EPD[1] | 131 | 130 | 132 | 126 | 123 | 123 | 122 | 123 |
| Puff Count | 7.6 | 7.6 | 7.7 | 7.6 | 7.9 | 7.7 | 7.6 | 7.7 |
| Deliveries (mg/cig) | | | | | | | | |
| CPM[2] | 16.9 | 16.7 | 16.7 | 17.4 | 16.6 | 16.4 | 16.6 | 17.3 |
| Tar | 13.9 | 13.9 | 13.8 | 14.3 | 13.3 | 13.8 | 13.5 | 13.9 |
| Nicotine | 1.01 | 0.88 | 1.01 | 0.89 | 1.05 | 0.83 | 1.01 | 0.86 |
| Water | 2.07 | 1.92 | 1.86 | 2.13 | 2.23 | 1.74 | 2.14 | 2.10 |
| Carbon Monoxide | 14.4 | 14.5 | 14.0 | 14.0 | 14.2 | 14.5 | 13.9 | 14.5 |
| Removal Efficiencies (%) | | | | | | | | |
| Water | 75.1 | 77.4 | 75.1 | 75.6 | 75.9 | 78.0 | 72.0 | 76.9 |
| Nicotine | 39.3 | (47.6) | 39.3 | (47.0) | 38.6 | (50.6) | 39.9 | (48.8) |
| Ratios | | | | | | | | |
| Tar/Nicotine | 13.7 | 15.8 | 13.7 | 16.1 | 12.7 | 16.7 | 13.3 | 16.2 |
| Tar/Water | 6.70 | 7.24 | 7.42 | 6.72 | 5.95 | 7.95 | 6.29 | 6.64 |
| Avail. Nic. (mg/cig) | 1.66 | 1.29 | 1.66 | 1.34 | 1.73 | 1.36 | 1.68 | 1.42 |

[1]EPD refers to Encapsulated Pressure Drop.
[2]CPM refers to Cambridge Particulate Matter.
[3]FAS refers to ferrous ammonium sulfate.
(Note: In Nicotine line, numbers in () are calculated. Calculation is based upon the average available nicotine from non-treated filter cigarettes used in study.)

EXAMPLE 2

The following example demonstrates that ferrous (+2) compounds, and not ferric (+3) compounds, remove the nicotine from tobacco smoke.

Standard cellulose acetate filter rods were treated, in the same manner described in Example 1, with the following aqueous solutions: 6% ferrous ammonium sulfate; 12% ferrous ammonium sulfate; water; 6% ammonium sulfate; 6% ferric ammonium sulfate; 6% ferric sulfate; 6% ferric nitrate. The results are set forth in Table II.

EXAMPLE 3

The following example demonstrates that the discoloration of the filter material attributable to the ferrous compound treatment can be prevented by increasing the acidity of the ferrous compound solution without detrimental effects of the nicotine removal efficiency.

Standard cellulose acetate filter rods (21 mm in length) were treated in the same manner set forth in Example 1 with the following aqueous solutions: control (no treatment); 1% phosphoric acid $H_3PO_4$); 6% ferrous ammonium sulfate/1%

TABLE II

| | Treatment | | | | | | | |
|---|---|---|---|---|---|---|---|---|
| | Water[1] | Control[2] | Ferrous Ammonium Sulfate 6% | Ferrous Ammonium Sulfate 12% | Ammonium Sulfate | Ferric Ammonium Sulfate | Ferric Sulfate | Ferric Nitrate |
| Add-On | — | 2.4% | 8.1% | 15.9% | 11.1% | 6.4% | 9.7% | 5.4% |
| Cigarette EPD | 140 | 140 | 140 | 140 | 140 | 135 | 135 | 140 |
| Puff Count | 7.7 | 7.9 | 7.7 | 7.7 | 7.8 | 7.6 | 7.8 | 8.2 |
| Deliveries (mg/cig) | | | | | | | | |
| Tar | 12.35 | 12.90 | 11.55 | 13.45 | 13.24 | 14.66 | 15.64 | 15.70 |
| Nicotine | 1.09 | 1.12 | 0.93 | 0.97 | 1.06 | 1.11 | 1.10 | 1.26 |
| | (0.142)* | (0.142)* | (0.121)* | (0.126)* | (0.136)* | (0.146)* | (0.141)* | (0.154)* |
| Water | 2.37 | 2.63 | 2.14 | 1.99 | 2.80 | 2.28 | 2.19 | 2.92 |
| Ratios Tar/Nic | 11.33 | 11.52 | 12.42 | 13.87 | 12.49 | 12.42 | 13.87 | 12.49 |

*mg of nicotine per puff
[1]water treated control
[2]untreated control phosphoric acid; 12% ferrous ammonium sulfate/1% phosphoric acid. The results are presented in Table III.

TABLE III

| | Treatment | | | |
|---|---|---|---|---|
| | Control | 1% $H_3PO_4$* | 6% FAS/ 1% $H_3PO_4$ | 12% FAS/ 1% $H_3PO_4$ |
| Cig. EPD | 140 | 138 | 138 | 138 |
| Puff count | 7.9 | 7.7 | 7.5 | 7.6 |
| Deliveries (mg/cig) | | | | |
| Tar | 12.9 | 13.04 | 13.94 | 13.69 |
| Nicotine | 1.12 | 0.88 | 0.95 | 0.97 |
| Water | 2.63 | 2.45 | 2.61 | 2.30 |
| Ratio Tar/Nic | 11.52 | 14.82 | 14.67 | 14.11 |

*Phosphoric acid - $H_3PO_4$

EXAMPLE 4

The procedure set forth in Example 3 was followed herein, except that the FAS solution was treated with monosodium phosphate (MSP) instead of phosphoric acid. A 5% by weight solution of FAS/MSP was used to treat the filter rods. These rods turned light gray after treatment. The results are set forth in Table IV.

TABLE IV

| | Control | 1 FAS/MSP | 2 FAS/MSP |
|---|---|---|---|
| Cigarette EPD | 126 | 132 | 132 |
| Deliveries (mg/cig) | | | |
| Tar | 14.54 | 13.19 | 12.91 |
| Nicotine | 1.22 | 1.04 | 1.03 |
| Water | 2.15 | 2.36 | 1.71 |
| Ratio Tar/Nicotine | 11.92 | 12.68 | 12.53 |

EXAMPLE 5

The procedure set forth in Example 1 was followed therein except that cupric nitrate (5% by weight aqueous solution) was substituted for the ferrous ammonium sulfate and the solution was only tested on standard 85 mm cellulose acetate filters. Filters treated with this solution turned blue. The results are set forth in Table IV.

TABLE V

| | Control | 1 $Cu(NO_3)_2$ | 2 $Cu(NO_3)_2$ |
|---|---|---|---|
| Cigarette EPD | 126 | 132 | 132 |

TABLE V-continued

| | Control | 1 $Cu(NO_3)_2$ | 2 $Cu(NO_3)_2$ |
|---|---|---|---|
| Puff Count | 7.6 | 7.6 | 7.6 |
| Deliveries (mg/cig) | | | |
| Tar | 13.63 | 13.17 | 12.62 |
| Nicotine | 1.20 | 0.89 | 0.91 |
| Water | 2.30 | 2.15 | 1.76 |
| Ratio Tar/Nicotine | 11.36 | 14.80 | 13.87 |

The present invention may be embodied in other specific forms without departing from the spirit or essential attributes thereof and, accordingly, reference should be made to the appended claims, rather than to the foregoing specification, as indicating the scope of the invention.

We claim:

1. A method for selectively removing a component from tobacco smoke comprising steps of:

contacting a filter material with a tobacco smoke; and filtering nicotine from the tobacco smoke with said filter material having disposed thereon a salt containing a metal having a valence of +2 selected from the group consisting of ferrous ammonium sulfate; cupric sulfate; cupric nitrate; cupric acetate; cobalt sulfate; cobalt nitrate; zinc sulfate; cadmium sulfate; nickel sulfate; magnesium acetate; mercuric acetate; mercuric chloride; and combinations thereof.

2. The method in accordance with claim 1, wherein the salt having a valence of +2 is ferrous ammonium sulfate.

3. The method in accordance with claim 1, wherein the salt containing a metal having a valence of +2 is cupric nitrate.

4. A tobacco smoke article comprising:

a filter including filter material, said filter material being selected from the group consisting of cellulose esters, polyolefins, activated carbon, high surface area carrier media, and combinations thereof; and means for selectively removing nicotine from tobacco smoke, said means including ferrous ammonium sulfate being disposed on said filter material.

5. A filter for a tobacco smoking article comprising:

a filter material, said filter material being selecting from the group consisting of cellulose esters, polyolefins, activated carbon, high surface area carrier media, and combinations thereof; and means for selectively removing nicotine from tobacco smoke, said means including ferrous ammonium sulfate being disposed on said filter material.

* * * * *